United States Patent [19]

Arendt

[11] 4,334,581

[45] Jun. 15, 1982

[54] BALANCED AREA SAFETY VALVE

[75] Inventor: Henry P. Arendt, Dallas, Tex.

[73] Assignee: Otis Engineering Corporation, Dallas, Tex.

[21] Appl. No.: 186,587

[22] Filed: Sep. 12, 1980

[51] Int. Cl.[3] ..... E21B 34/10

[52] U.S. Cl. ..... 166/324

[58] Field of Search ..... 166/321, 324

[56] References Cited

U.S. PATENT DOCUMENTS

| | | | |
|---|---|---|---|
| 3,860,066 | 1/1975 | Pearce et al. | 166/324 |
| 4,201,363 | 5/1980 | Arendt et al. | 166/324 |
| 4,273,186 | 6/1981 | Pearce et al. | 166/324 |

*Primary Examiner*—James A. Leppink

*Attorney, Agent, or Firm*—Vinson & Elkins

[57] ABSTRACT

A single line surface controlled, subsurface safety valve, adapted for connection in a well tubing string. The safety valve has a closure means disposed in the bore of the safety valve housing and is operable by action of control pressure fluid causing a longitudinal operator to move the closure means to an open to flow position. The control pressure fluid chamber in the safety valve is protected from well pressure by providing annular areas, between the longitudinal operator and the housing, positioned between the control pressure fluid chamber and well pressure. The annular areas are sealed from exposure to well pressure and are in fluid communication with each other. A floating piston is positioned to respond to well pressure entering the annular areas and thus move to engage and assist the operator means in closing the safety valve to flow of well fluids therethrough. Vent means is provided to prevent a hydraulic lock from retarding movement of the floating piston.

10 Claims, 2 Drawing Figures

BALANCED AREA SAFETY VALVE

BACKGROUND OF THE INVENTION

A. Field of the Invention

This invention relates to surface controlled subsurface safety valves utilized to control flow at a subsurface location in a well. More particularly, the safety valve has a single control line and is connectable in and is retrievable with well tubing.

B. Prior Art

When properly installed as part of a subsurface safety system in a well, safety valves are designed to automatically shut-in a well below the earth's surface in the event of erratic changes in flowline pressures, damage to the wellhead or malfunction of surface equipment. Safety valves are designed to be either installed in a tubing string or made up as part of the tubing string. Regardless of the manner in which they are installed in a well installation, they are designed to close on demand from the surface of the well, providing the well operator with complete control of the valve's operation.

Typical of the safety valves available are those illustrated on page 5981 of the *Composite Catalog of Oil Field Equipment and Services,* Vol. 4, 34th Ed., 1980–81. There is shown a Type DL ball safety valve and a Type QLP flapper safety valve, manufactured and sold by Otis Engineering Corporation. Each of these valves is designed to be connected in and retrievable with the tubing string. For this reason, they are typically referred to as "tubing retrievable" safety valves.

Another feature of the illustrated safety valves is that they are operated by a single pressure fluid line extending from the valve to a source of pressure fluid at the surface of the well. The pressure fluid arriving at the valve enters a variable capacity pressure chamber which expands upon an increase in pressure transmitted to the valve from the surface of the well. The variable capacity pressure chamber is usually housed in an annular area located between the safety valve housing and an inner, longitudinally movable tubular sleeve. This sleeve, when moved downward operates to open a closure device allowing well fluids to flow through the safety valve.

The sleeve noramlly is biased by a spring or some other resilient urging means so that upon release of pressure in the variable capacity pressure chamber, the sleeve is moved back to its first position, allowing the closure device to return to its closed-to-flow position.

Thus, in order to accomplish its "safety" function, the valve must be able to close upon release of pressure in the variable capacity pressure chamber. The pressure chamber is normally isolated from well pressure by O-ring or other types of seals being placed so as to seal off an area in the annular space between the operator sleeve and the safety valve housing. In the event a seal fails, well pressure can enter the pressure chamber. If the well pressure exceeds the spring force required to close the safety valve, the well cannot be closed to flow. Also, well pressure can invade the conduit used to transmit pressure fluid to the valve, causing a blowout through the conduit.

OBJECTS OF THE INVENTION

It is an object of the invention to provide a surface controlled subsurface safety valve having an improved means of preventing well pressure from holding the safety valve in the open to flow position.

It is another object of the invention to provide a surface controlled subsurface safety valve having means to intercept well pressure, upon failure of a seal, to prevent well pressure from interferring with closure to flow of the safety valve.

Yet another object of the invention is to provide a surface controlled subsurface safety valve with a means to intercept well pressure entering the annular area between the operator sleeve and the housing and to use the well pressure to assist in closing the safety valve to flow therethrough.

It is another object of the invention to provide a single-line surface controlled, tubing retrievable subsurface safety valve with means, disposed between the area receiving control fluid and the areas of the safety valve exposed to well pressure, to intercept well pressure leaking past sealing means and to then utilize said well pressure in assisting the operator sleeve to close the safety valve to flow therethrough.

Another object of the invention is to provide a single-line surface controlled, tubing retrievable subsurface safety valve with means to use well pressure to assist in closing the safety valve to flow therethrough and additionally, to provide means to prevent hydraulic lock of the operator sleeve which might hinder closing the safety valve to flow therethrough.

These and other objects and features of this invention, and the advantages thereof, will be apparent from the following detailed description of the preferred embodiments of the invention when read in conjunction with the accompanying drawings.

BRIEF DESCRIPTION OF THE DRAWINGS

In the drawings, wherein like numerals indicate like parts, and wherein an illustrative embodiment of this invention is shown.

DETAILED DESCRIPTION OF THE PREFERRED EMBODIMENTS

Figure 1:
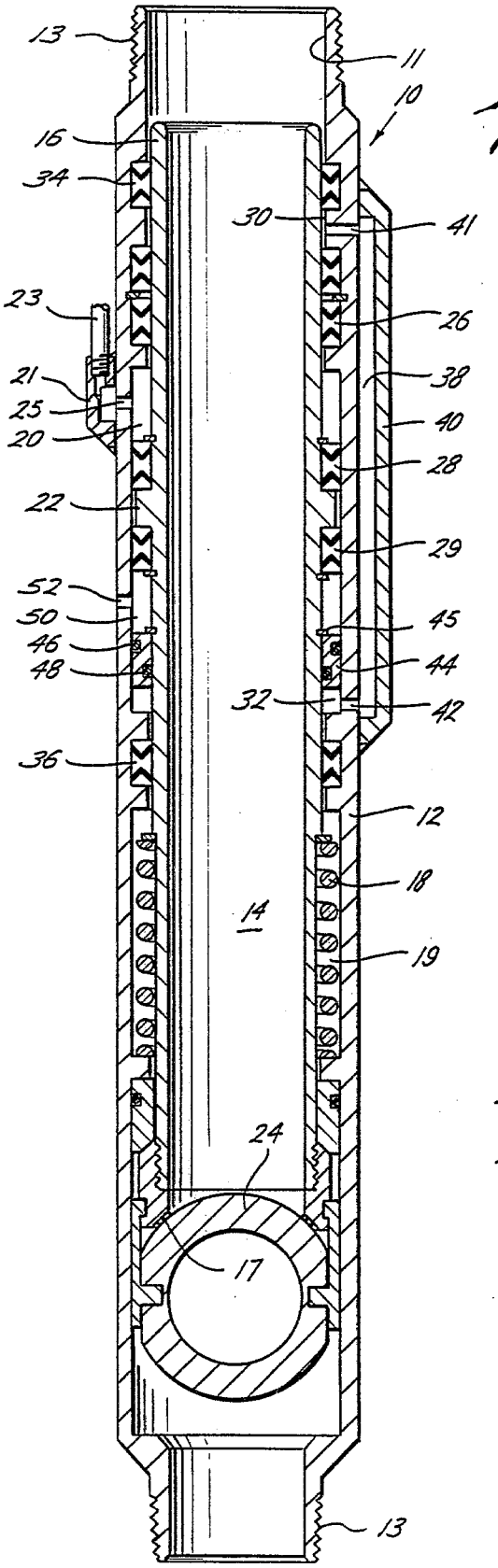
FIG. 1 is a cross-sectional schematic view of a single-line surface controlled, subsurface savety valve embodying the novel features of the present invention.

As previously discussed, an important criterion that industry has selected for surface controlled subsurface safety valves is that valve closure should be failsafe. Regardless of pressure conditions at the valve, the surface controlled subsurface safety valve should close upon reduction of control fluid pressure. If possible, if well pressure is present it should assist valve closure and should not retard valve closure.

In U.S. Pat. No. 4,149,698, assigned to Otis Engineering Corporation, well pressure can be used to assist in closure of the safety valve. However, the safety valve in that patent is a two-line type using a second conduit extending from the safety valve to the surface of the well. Pressure fluid in the second line is used to offset the hydrostatic head of the column of pressure fluid in the control line. Acting on the bottom of pressure responsive means used to open the safety valve, the effect of the hydrostatic head of pressure fluid is cancelled out, leaving the biasing means to normally close the safety valve to flow. However, a floating piston is utilized to assist closure of the safety valve when well pressure is greater than the force exerted by the column of fluid in the balance line.

However, it is to be noted in the drawings of the patent that there is only one seal protecting the variable capacity pressure chamber from well pressure in the tubing. Failure of that one seal would allow well pressure to invade the area of the safety valve used to open the valve closure member. If well pressure is greater than the biasing force used to close the valve, the valve will be held in the open-to-flow position.

In the present invention, there is provided a single-line 23 surfaced controlled subsurface safety valve 10, as illustrated in FIG. 1. The safety valve 10 comprises a tubular housing 12 having a longitudinal bore 11 extending therethrough defining a flow path 14 and having closure means 24 disposed in said bore for controlling flow of well fluids through the flow path 14. Preferably, the safety valve 10 is connectable in well tubing. Thus, the housing 12 has suitable connecting means 13 for this purpose.

The closure means 24, illustrated in FIG. 1 is a ball-type, such as is provided in the DL-type safety valve manufactured by Otis Engineering Corporation, illustrated on page 5981 of the *Composite Catalog,* supra. It is well known, of course, that a flapper-type closure member is equally suitable in controlling flow through a safety valve.

The closure means 24 is operated by operator means 16 which is longitudinally movable with respect to the tubular housing 12. The operator means 16 is shown in FIG. 1 to be a tubular sleeve disposed in the bore 11 of the tubular housing 12. The operator means 16 has a first position, shown in FIG. 1, wherein the closure means 24 closes the flow path 14; and, it has a second position wherein the closure means 24 opens the flow path 14 to the flow of well fluids. Preferably, a suitable seating surface 17 is provided on the operator means 16 to seal against the closure means 24.

The operator means 16 is moved to its second position by the force of a pressure fluid, such as hydraulic fluid, entering a variable capacity pressure chamber 20 positioned in the annular area between the operator means 16 and the tubular housing bore 11. The force of the pressure fluid acts on a pressure responsive means 22, which forms part of the operator means 16. The pressure responsive means 22 is sometimes referred to hereinafter as a piston. The "piston" 22 can either be a portion of the operator means 16 or be a separate element engageable with the operator means 16 to move the operator means 16 to its second position in response to an increase in pressure within the variable capacity pressure chamber 20.

Control pressure fluid is conducted to the safety valve 10 through suitable conduit 23 extending from the safety valve 10 to a suitable pressure fluid source (not shown) at the surface of the well. The conduit 23 terminates at the safety valve 10 at a weldment 21 or other suitable means. Control pressure fluid within the conduit 23 and weldment 21 enters the variable capacity pressure chamber 20 by way of a port 25 extending laterally through the housing 12.

In order to confine the control pressure fluid within the variable capacity pressure chamber 20, there is normally provided sealing means 26 and 28 to seal the annular area between the operator means 16 and the bore 11. Preferably, the seal effective area of seals 26 and 28 is equal.

As discussed previously, it is desirable to have the safety valve closure means 24 move to its closed-to-flow position upon a reduction of pressure in the control pressure chamber 20. This is preferably done by providing a biasing means 18 for urging the operator means 16 to move to its first position. In the embodiment illustrated in FIG. 1, the biasing means is a spring 18, housed in an annular area 19 between the operator means 16 and the bore 11. The spring 18 engages the operator means 16 in such a manner as to provide a force sufficient to urge the operator means 16 to its first position upon reduction of the force applied to the piston 22 exposed to pressure fluid in the control pressure chamber 20. In normal use, the annular area 19 housing the biasing means 18 is exposed to well pressure.

The novelty of the present invention resides in several features of the safety valve 10, illustrated in FIG. 1, which will be more particularly described hereinafter.

The safety valve 10 of the present invention, is provided with annular areas 30 and 32, positioned between the operator means 16 and the housing bore 11, which are sealed from exposure to well pressure in the bore. The annular areas 30 and 32 are positioned, with respect to the variable capacity pressure chamber 20 so as to intercept well pressure in the event of failure of seals 34 and 36, which seal the annular areas 30 and 32 from well bore pressure.

Referring to FIG. 1, it is seen that the annular area 30 can be referred to as the "upper" area, since it would be positioned in the uppermost portion of the annular area between the operator sleeve 16 and the bore 11. Suitable sealing means 34, shown in the drawing to be held by the housing 12, seals the upper area 30 from exposure to well pressure present in the flow path 14 when the safety valve 10 is connected in well tubing. Suitable sealing means 26 is positioned between the upper area 30 and the variable capacity pressure chamber 20.

In a similar manner, there is provided a "lower" annular area 32, sealed from well pressure by a suitable sealing means 36.

Placement of these two annular areas 30 and 32 provides protection for the control function of the variable capacity pressure chamber 20. If the outermost seals 34 and 36 fail, well pressure will enter these annular areas 30 and 32.

The annular areas 30 and 32 are preferably provided with fluid communication means 38, which is shown to be a fluid passageway housed in a weldment 40 positioned on the exterior of the housing 12. A lateral port 41 provides fluid communication between the fluid passageway 38 and the upper annular area 30. Likewise, a lateral port 42 provides fluid communication between the fluid passageway 38 and the lower annular area 32.

There is additionally provided in the safety valve 10 a pressure responsive means 44 which is engageable with the operator means 16, and which is exposable to well bore pressure entering at least one of the annular areas 30 or 32, to assist the operator means 16 in moving to its first position. The pressure responsive means 44 is preferably a piston and is shown in FIG. 1 to be a floating piston ring housed in the annular area between the operator means 16 and the bore 11. At least one surface of the floating piston 44 is exposed to any pressure which may enter the lower annular area 32.

If there is sufficient well pressure entering the annular area 32, the floating piston 44 will move longitudinally toward the upper end of the safety valve 10 and engage a stop means 45 on the operator means 61. If the pressure is of sufficient force, the floating piston can assist the biasing means 18 in moving the operator means 16 to its first position. The stop means 45 can suitably be a snap ring or other shoulder on the operator means 16.

The floating piston is shown carrying seals 46 and 48. These seals 46 and 48 permit the force of well pressure to be confined to the piston surface forming a part of the lower annular area 32. The opposite piston surface forms part of an annular area 50 disposed longitudinally above the lower annular area 32. In fact, this annular area is positioned between the variable capacity pressure chamber 20 and the lower annular area 32. Due to the movability of the floating piston 44, this annular area 50 is considered to have a variable volume.

It will be seen in FIG. 1 that the variable volume annular area 50 is formed on one side thereof by suitable sealing means 29 and on the other side by the sealing means 46 and 48 carried on the floating piston 44. Thus, movement of the floating piston 44, in response to well pressure acting thereon, causes a reduction in volume in the variable volume annular area 50.

If, however, hydraulic or other fluids have somehow entered this variable volume annular area 50, a hydraulic lock can be created preventing the effective movement of the floating piston 44 to engage and assist the operator means 16.

Thus, there is preferably provided some sort of vent means 52, through the housing 12, to provide fluid communication between the annular variable volume area 50 and the exterior of housing 12, whereby a reduction of volume in the annular variable area 50 will cause fluids contained therein to be expelled therefrom through the vent means 52.

Figure 2:
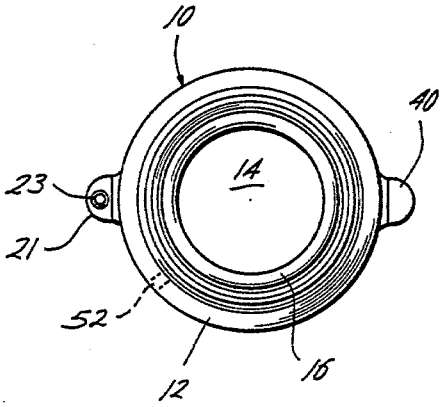
FIG. 2 is a plan view of the safety valve of the present invention showing possible positioning of exterior weldments.

FIG. 2 illustrates a possible arrangement of the weldments 21 and 40 positioned on the housing 12 of the safety valve 10. The vent means 52 is shown in dashed lines to be a suitable port extending through the housing 12 to the exterior of the housing 12.

The foregoing disclosure and description of this invention are illustrative and explanatory thereof, and various changes in the size, shape and materials, as well as the details of the illustrated construction, may be made within the scope of the appended claims without departing from the spirit of the invention.

What is claimed is:

1. A subsurface safety valve comprising a tubular housing having a longitudinal bore extending therethrough defining a flow path, closure means disposed in said bore for controlling flow through said flow path, operator means longitudinally movable with respect to said tubular housing for moving said closure means and having a first position wherein said closure means closes said flow path and having a second position wherein said closure means opens said flow path, a sealed variable capacity pressure chamber for receiving control pressure fluid from a source exterior to said housing, control fluid pressure responsive means for moving said operator means from said first position to said second position when affected by fluid pressurized above a selected value, biasing means for urging said operator means to move to its first position, annular areas, between said operator means and said housing sealed from exposure to well pressures in said bore, said annular areas being positioned with respect to said variable capacity pressure chamber so as to intercept well pressure, in said bore, in the event of said annular area seal failure, fluid communication means connecting said annular areas, and pressure responsive means engageable with said operator means and exposable to well bore pressure entering at least one of said annular areas to assist said operator means in moving to its first position.

2. The subsurface safety valve of claim 1, wherein there is positioned longitudinally, on each side of said variable capacity pressure chamber, at least one of said annular areas, and there is provided seal means to seal said annular areas from well bore pressure and from control pressure in said variable capacity pressure chamber.

3. The subsurface safety valve of claim 1, wherein said pressure responsive means is a piston, movable in response to well bore pressure entering at least one of said annular areas to engage said operator.

4. The subsurface safety valve of claim 3, including seal means carried on said pressure responsive means to provide a sealing relation between said pressure responsive means and said operator means and said housing, and the pressure responsive means being positioned in an annular chamber, between said operator means and said housing.

5. The subsurface safety valve of claim 4, including an annular, variable volume area defined on one side by said pressure responsive means, and vent means providing fluid communication between said annular, variable volume area and the exterior of said housing, whereby a reduction of volume in said annular, variable volume area will cause fluids contained therein to be expelled therefrom through said vent means.

6. A subsurface safety valve comprising a tubular housing, connectable in a well tubing string, having a longitudinal bore extending therethrough defining a flow path, closure means disposed in said bore for controlling flow through said flow path, operator means longitudinally movable with respect to said tubular housing for moving said closure means and having a first position wherein said closure means closes said flow path and having a second position wherein said closure means opens said flow path, a sealed, variable capacity pressure chamber for receiving control pressure fluid from a source exterior to said housing, piston means on said operator means responsive to control fluid pressure, in said variable capacity chamber, to cause said operator means to move from said first position to said second position when acted upon by control fluid pressurized above a selected value, biasing means for urging said operator means to move to its first position, first and second annular areas, between said operator and said housing, sealed from exposure to well pressure in said bore, said first and second annular areas being positioned on each side of, and sealed from, said variable capacity pressure chamber, pressure responsive means in at least one of said annular areas for assisting said biasing means for urging said operator means to move to its first position in the event well pressure enters said annular areas, and means for providing fluid communication between said annular areas.

7. The subsurface safety valve of claim 6, including an annular, variable volume area defined on one side by said pressure responsive means, and vent means providing fluid communication between said annular, variable volume area and the exterior of said housing, whereby a reduction of volume in said annular, variable volume area will cause fluids contained therein to be expelled therefrom through said vent means.

8. A subsurface safety valve comprising a tubular housing, connectable in a well tubing string, having a longitudinal bore extending therethrough defining a flow path, closure means disposed in said bore for controlling flow through said flow path, operator means longitudinally movable with respect to said tubular housing for moving said closure means and having a first position wherein said closure means closes said flow path and having a second position wherein said closure means opens said flow path, a sealed, variable capacity pressure chamber for receiving control pressure fluid from a source exterior to said housing, piston means on said operator means responsive to control fluid pressure, in said variable capacity pressure chamber, to cause said operator means to move from said first position to said second position when acted upon by control fluid pressurized above a selected value, biasing means for urging said operator means to move to its first position, a first annular area, between said operator and said housing, sealed from exposure to well pressure, a second annular area, between said operator and said housing, sealed from exposure to well pressure, means for providing fluid communication between said first and second annular areas, second piston means, engagable with said operator, responsive to well pressure entering said first or second annular area, for assisting said biasing means to move said operator to its first position, vent means, in fluid communication with the exterior of said housing, for venting fluids upon movement of said second piston means to engage said operator means.

9. The subsurface safety valve of claim 8, including an annular, variable volume chamber defined on one side thereof by a portion of said second piston means, movable in response to well pressure entering either of said first or second annular areas, to reduce the volume of said variable volume chamber, and said vent means providing fluid communication between said variable volume chamber and the exterior of said housing.

10. The subsurface safety valve of claim 8, wherein said first and second annular areas are positioned between said sealed, variable capacity pressure chamber and seals sealing said first and second annular areas from well pressure in said bore, whereby well pressure bypassing said seals enters said first and second annular areas without entering said variable capacity pressure chamber.

* * * * *